United States Patent [19]

White et al.

[11] Patent Number: 4,771,795

[45] Date of Patent: Sep. 20, 1988

[54] SMOKING ARTICLE WITH DUAL BURN RATE FUEL ELEMENT

[75] Inventors: Jackie L. White, Pfafftown; Bradley J. Ingebrethsen, Winston-Salem, both of N.C.

[73] Assignee: R. J. Reynolds Tobacco Company, Winston-Salem, N.C.

[21] Appl. No.: 863,646

[22] Filed: May 15, 1986

[51] Int. Cl.[4] ..... A24D 1/02; A24D 1/18

[52] U.S. Cl. ..... 131/194; 131/335; 131/359; 131/360; 131/364

[58] Field of Search ..... 131/194, 195, 335, 359, 131/360, 364

[56] References Cited

U.S. PATENT DOCUMENTS

| | | |
|---|---|---|
| 2,349,551 | 5/1944 | Helm . |
| 2,907,686 | 10/1959 | Siegel . |
| 3,258,015 | 6/1966 | Ellis . |
| 3,349,776 | 10/1967 | Bell . |
| 3,356,094 | 12/1957 | Ellis . |
| 3,516,417 | 6/1970 | Moses . |
| 3,614,956 | 10/1971 | Thornton . |
| 3,674,036 | 7/1972 | Vega . |
| 3,738,374 | 6/1973 | Bennett . |
| 3,756,249 | 9/1973 | Selke . |
| 3,863,644 | 2/1975 | Hunt . |
| 3,905,377 | 9/1975 | Yatides . |
| 3,943,941 | 3/1976 | Boyd . |
| 4,019,521 | 3/1977 | Briskin . |
| 4,027,679 | 6/1977 | Kaswan . |
| 4,044,777 | 8/1977 | Boyd . |
| 4,079,742 | 3/1978 | Ranier . |
| 4,133,317 | 1/1979 | Briskin . |
| 4,219,031 | 8/1980 | Ranier . |
| 4,286,604 | 9/1981 | Ehretsmann . |
| 4,326,544 | 4/1982 | Hardwick . |
| 4,340,072 | 7/1982 | Bolt . |
| 4,391,285 | 7/1983 | Burnett . |
| 4,474,191 | 10/1984 | Steiner . |
| 4,481,958 | 11/1984 | Ranier . |

FOREIGN PATENT DOCUMENTS

| | | |
|---|---|---|
| 687136 | 11/1963 | Canada . |
| 117355 | 9/1984 | European Pat. Off. . |
| 13985/3890 | 9/1985 | Liberia . |
| 956544 | 5/1968 | United Kingdom . |
| 1185887 | 3/1970 | United Kingdom . |
| 1431045 | 4/1972 | United Kingdom . |

OTHER PUBLICATIONS

Tobacco Substitutes, (Noyes Data Corp., 1976).

*Primary Examiner*—V. Millin

*Attorney, Agent, or Firm*—Grover M. Myers; David G. Conlin

[57] ABSTRACT

The present invention preferably relates to a smoking article which is capable of producing substantial quantities of aerosol, both initially and over the useful life of the product, without significant thermal degradation of the aerosol former and without the presence of substantial pyrolysis or incomplete combustion products or sidestream aerosol. The article employes a dual burn rate fuel element, which utilizes a fast burning segment and a slow burning segment.

The use of such a dual burn rate fuel element has several advantages over conventional homogeneous fuels. For example, the fast burning component assists in the ease of lighting the fuel element, and provides rapid heat transfer to the aerosol generating means. This in turn, provides early aerosol delivery.

The slow burning component provides for even heat distribution throughout the burn period. The slow burning material ensures steady aerosol delivery in terms of amount and provides adequate fuel for simulating the number of puffs obtained from a conventional cigarette, i.e., about nine or ten, when smoked under standard FTC conditions.

28 Claims, 1 Drawing Sheet

SMOKING ARTICLE WITH DUAL BURN RATE FUEL ELEMENT

FIELD OF THE INVENTION

The present invention relates to a cigarette-like smoking article, with a tabaccoless fuel element, which article produces an aerosol that resembles conventional tabacco smoke and which preferably contains no more than a minimal amount of incomplete combustion or pyrolysis products.

The present invention utilizes a two component tobacco substitute fuel and a physically separate aerosol generating means situated axially within said fuel. Combustion gases from the fuel are preferbly excluded from the mainstream aerosol.

BACKGROUND OF THE INVENTION

Many tobacco substitute smoking materials have been proposed through the years, especially over the last 20 to 30 years. These proposed tobacco substitutes have been prepared from a wide variety of treated and untreated materials, especially cellulose based materials. Numerous patents teach proposed tobacco substitutes made by modifying cellulosic materials, such as by oxidation, by heat treatment, or by the addition of materials to change the properties of the cellulose. One of the most complete lists of these substitutes is found in U.S. Pat. No. 4,079,742 to Rainer et al.

Many patents describe the preparation of tobacco substitute smoking materials from various types of carbonized (i.e., pyrolyzed) cellulosic material. These include U.S. Pat. No. 2,907,686 to Siegel, U.S. Pat. No. 3,738,374 to Bennett, U.S. Pat. Nos. 3,943,941 and 4,044,777 to Boyd et al., U.S. Pat. Nos. 4,019,521 and 4,133,317 to Briskin, U.S. Pat. No. 4,219,031 to Rainer, U.S. Pat. No. 4,286,604 to Ehretsmann et al., U.S. Pat. No. 4,326,544 to Hardwick et al., U.S. Pat. No. 4,481,958 to Rainer et al., Great Britian Pat. No. 956,544 to Norton, Great Britain Pat. No. 1,431,045 to Boyd et al., and European Patent Application No. 117,355 by Hearn, et al. In addition, U.S. Pat. No. 3,738,374 to Bennett teaches that tobacco substitutes may be made from carbon or graphite fibers, mat or cloth, most of which are made by the controlled pyrolysis of cellulosic materials, such as rayon yarn or cloth.

Cigarette-type smoking articles which preclude the introduction of combustion gases into the mainstream aerosol are known. Generally this is accomplished by providing a chamber or passageway for the mainstream aerosol source and a physically separate fuel, the mainstream aerosol being prevented from mixing with the combustion products produced by the burning fuel.

For example, Ellis et al. in U.S. Pat. No. 3,258,015, describe several embodiments of proposed cigarette-like smoking articles having an axially extending aerosol/nicotine releasing tabular member, typically surrounded by the tobacco fuel. The physical arrangement of this system precluded entry of any of the combustion products into the tubular member which carried the mainstream aerosol. Similar propsed devices are described in Synectic British Pat. No. 1,185,887.

Likewise, in certain embodiments of Moses, U.S. Pat. No. 3,516,417, cigarette-like smoking articles are described wherein tobacco is burned to generate heat, and this heat is used to warm air which is delivered to the user. There is no contamination of the heated air by the combustion products of the burning tobacco.

Similarly, in Steiner, U.S. Pat. No. 4,474,191, proposed smoking articles are described in which, except for a brief temporary period at the moment of lighting, combustion gases are not delivered to the user. The mainstream aerosol comprises volatile and/or sublimable materials disposed within a channel separated from the heat source.

Cigarettes and cigarette-like smoking articles have also been provided with draft passages or similar tubular members extending longitudinally through the fuel, but generally such articles do not exclude combustion products from the mainstream aerosol.

For example, Helm, in U.S. Pat. No. 2,349,551, describes a cigarette modified to have disposed centrally within the tobacco charge, an impervious draft tube, through which combustion gases will pass, following the path of least resistance. Bell et al. in U.S. Pat. No. 3,349,776 describe a low temperature cigarette having an axially extending draft column. Ellis et al., in U.S. Pat. No. 3,356,094, describe an improvement over their eariler patent (supra) wherein the tubular member became frangible upon exposure to heat. Levavi, in Canadian Pat. No. 687,136, described proposed cigarettes with tubes, some of which were metal and some of which burned slowly, for controlling the amount of tar and nicotine delivered to the user.

Similarly, Vega, in U.S. Pat. No. 3,674,036, describes a cigarette-like smoking article having a centrally located perforated tubular core member which permits fresh air passage through the tobacco, thereby slowing down the combustion. Thorton, in U.S. Pat. No. 3,614,956, describes a smoking article comprising a tobacco fuel having an axially disposed absorbent core which serves to absorb noxious materials from the combustion gases. The core may be separated from the tobacco fuel by means of a ceramic sleeve.

Likewise, Selke et al. in U.S. Pat. No. 3,756,249, describe a smoking article such as a cigarette which contains an axially extending tube which serves as an air passageway during smoking. Hunt, in U.S. Pat. No. 3,863,644, describes a smoking article having two or more tube-like chambers of different length, which chambers provide a programmed air ventilation effect during the smoking of the article. Yatrides, in U.S. Pat. No. 3,905,377, describes smoking articles provided with a blind conduit allowing the passage of air to the tobacco, thereby increasing the condensation of toxic vapors in the combustion gases.

Kaswan, in U.S. Pat. No. 4,027,679, describes a cigarette having disposed therein a ceramic or metallic smoke vector, open at the lighting end and sealed at the mouth end. This vector is said to reduce the draw heat of the article, thereby reducing the amount of pyrolysis products in the aerosol.

Bolt et al., in U.S. Pat. No. 4,340,072, describe a proposed smoking article having a fuel rod with a central air passageway and a mouthend chamber containing an aerosol forming agent. The fuel rod preferably is a molding or extrusion of reconstituted tobacco and/or tobacco substitute, although the patent also proposes the use of tobacco, a mixture of tobacco substitute material and carbon, or a sodium carboxymethylcellulose (SCMC) and carbon mixture. The aerosol forming agent is proposed to be a nicotine source material, or granules or microcapsules of a flavorant in triacetin or benzyl benzoate. Upon burning, air enters the air passage where it was mixed with combustion gases from the burning rod. The flow of these hot gases reportedly ruptures the granules or microcapsules to release the volatile material. This material reportedly forms an aerosol and/or is transferred into the mainstream aerosol. Similar articles are described in FIG. 4 of the Moses patent, supra using a tobacco fuel and in the Hearn European Patent, supra, using a carbonized fuel.

Burnett et al., in U.S. Pat. No. 4,391,285, describe proposed smoking articles comprising a high density combustible tobacco containing fuel having at least one passageway extending longitudinally therethrough. This passageway may contain an easily ignitable air permeable plug which may optionally contain thermally releaseable flavorants.

Clearly, despite decades of interest and effort, none of the aforesaid smoking articles have been found to be satisfactory as a cigarette substitute. Indeed, despite extensive interest and effort, there is still no smoking article on the market which provides the benefits and advantages associated with conventional cigarette smoking, without delivering considerable quantities of incomplete combustion and/or pyrolysis products.

SUMMARY OF THE INVENTION

The present invention relates to a cigarette-like smoking article which is capable of producing substantial quantities of smoke-like aerosol, both initially and over the useful life of the product, preferably without significant thermal degradation of the aerosol former and without the presence of substantial pyrolysis or incomplete combustion products or sidestream smoke.

These and other advantages are obtained by providing an elongated, cigarette-type smoking article which utilizes a long, e.g., greater than about 40 mm, dual burn rate carbonaceous fuel element which preferably circumscribes a physically separate axially extending aerosol generating means.

In the preferred smoking article of the present invention, the fuel element is a carbonaceous mass, generally in the form of an annular member, preferably at least about 40 mm in length, having an inner diameter of from about 1.5 mm to 3.5 mm, and an outer diameter of from about 3.5 mm to 7.1 mm. The central cavity of the fuel element surrounds and retains a metallic container or chamber for the aerosol generating means.

The dual burn rate fuel element of the present invention comprises two carbonaceous segments; a slow burning portion and a fast burning portion. Typically, the fast burning portion of this fuel element comprises a mixture of a binder and a carbon which is low in density, porous, and is thus relatively fast burning. The slow burning portion of this fuel element generally comprises a mixture of a binder and a carbon which is higher in density, and more nonporous (than the fast burning portion), and is thus relatively slow burning.

The aerosol generating means generally comprises a heat stable substrate and at least one aerosol forming material. Because of its physical location, the aerosol generating means is in a conductive heat exchange relationship with the fuel element at all times during the burning of the fuel.

Conductive transfer of heat from the burning fuel element to the aerosol generating means causes volatilization of the aerosol forming material contained therein, which in turn is delivered to the user in the form of a "smoke-like" aerosol through the mouth end of the article.

The use of a dual burn rate fuel element has several advantages over conventional homogeneous fuel elements. For example, the fast burning component assists in the ease of lighting the fuel element, and provides rapid heat transfer to the aerosol generating means. This in turn helps provide early aerosol delivery. The slower burning component provides for even heat distribution throughout the burn period. The slow burning material ensures steady aerosol delivery in terms of amount and provides adequate fuel for simulating the number of puffs obtained from a conventional cigarette, i.e., about nine or ten, as determined by smoking under standard FTC conditions.

In one preferred embodiment, the combination of the fast burning segment of the fuel element and the slow burning segment of the fuel element, totally circumscribes the periphery of the aerosol generating means. The fast burning segment may contact from about 10% to 90%, preferably from about 25% to 75%, most preferably from about 40% to 60% of the periphery of the container for the aerosol generating means, with the slow burning segment contacting the remaining portion.

In another embodiment, the fuel element comprises adjacent fast burning and slow burning annular segments arranged along the periphery of the aerosol generating means. Preferably, the fast burning annular segment comprises a short section, of about 2 to 10 mm in length, which is situated at the lighting end of the article, and the slow burning annular segment, about 38 to 65 mm in length, is abutted thereto. Most preferably, embodiments of this type utilize a fast burning segment at the lighting end about 2 mm in length, and a slow burning segment about 58 mm in length.

In another embodiment of the dual burn rate fuel element of the present invention, the fuel segments are arranged concentrically about the aerosol generating means. Preferably, the more dense, slow burning segment is in direct contact with the periphery of the aerosol generating means, and the fast burning segment is disposed around the periphery of the slow burning segment.

In each of the embodiments described herein, it is preferred that the entire aerosol generating means be enclosed or embedded within the fuel element, but if desired, a partially enclosed or embedded aerosol generating means may be employed.

In preferred embodiments, the dual burn rate fuel element is prepared from cotton and kapok fibers, which are separately carbonized at a temperature between about 400° C. and 850° C. The pyrolyzed masses are then each mixed with an appropriate binder, and molded into their respective segments of the fuel element. In general, the fibers are carbonized in a non-oxidizing atmosphere, e.g., in an inert gas or in a vacuum. A preferred carbonizing temperature for these and like fibers, in about 650° C.

A most preferred dual burn rate fuel element is prepared by separately admixing the carbonized fibers for each of the segments (10 parts by weight) with sodium carboxymethylcellulose (1 part by weight) to form two pastes. Most preferably, the fibers used for the fast burning segment comprise a mixture of cotton and kapok. The most preferred fibers used for the slow burning segment are cotton fibers. These pastes, each representing one half of the final annular form of the fuel element, are molded together into a rod of approximately 4.5 mm in outer diameter and about 55 mm in length, having an axially extending heat conducting tube (e.g., metal) situated therein.

A metallic, preferably stainless steel, tube serves as the preferred container or capsule for the aerosol generating means of this invention. Generally the tube extends from one end of the fuel element to the other, with openings at both ends. This end to end placement of the tube avoids the introduction of significant amounts of combustion gases into the mainstream aerosol which is delivered to the user. If desired however, the tube may be recessed from the lighting end of the fuel, e.g., from about 2 to 5 mm, thereby allowing the introduction of a small amount of fuel combustion gases into the mainstream aerosol.

Preferably, the metal tube has a very thin wall thickness, e.g., less than about 0.05 mm. An especially preferred material for use in such tubes is a stainless steel foil having a thickness of about 0.01 mm (0.0005 in.). Tubes having such wall thickness are particularly desirable in the articles of the present inventions, as they permit the use of the preferred thin fuel elements. Thicker metallic tubes tend to extinguish the preferred fuel elements, decreasing the performance characteristics to unacceptable levels.

In preferred embodiments, the entire periphery of the fuel element is wrapped with an insulating member, such as a resilient glass fiber jacket which brings the outer diameter of the article up to that of a conventional cigarette, i.e, to from about 7.5 to 8.0 mm. This insulating member is generally at least about 0.5 mm, preferably about 1.0 mm thick. The presence of such an insulating member aids in retaining and directing heat from the burning fuel element to the aerosol generating means. The insulating member also serves to reduce any fire causing propensity of the article, and retains any ash remaining after the fuel element has been consumed.

Smoking articles of the present invention have also been prepared_ wherein the insulating member (e.g., glass fiber) was molded onto the outermost periphery of the carbon fuel rather than merely being wrapped around the carbon fuel. In preferred embodiments of this type, the insulating member was prepared from short lengths of glass fiber (about 1.6 mm) which were mixed with a binder, e.g., sodium carboxymethylcellulose, and sufficient water to form a thick paste. This paste was then molded around the carbon fuel segment.

In embodiments utilizing an insulating member according to the present invention, it is desirable to place a sealing or barrier means, e.g., a heat resistant, impervious member, at the mouth end of the cabon fuel element/insulating member, to prevent leakage of combustion gases through the carbon or insulating member. Suitable sealing means include inorganic materials in admixture with aqueous inorganic salt solutions, e.g., sodium silicate, sodium chloride and the like, or binders to make a paste, solid blocks of machineable ceramics, and the like. Of course, an air passageway located so as to abut the mouth end of the aerosol generating means must be present to allow delivery of the aerosol to the user. This sealing means also acts to separate the carbon and insulating material from the mouthend piece of the article.

The mouthend piece of the articles of this invention may consist of a hollow tube, a section of tobacco rod, cigarette filter material, or any combination of these elements.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3.0 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions. More preferably, preferred embodiments deliver 20 to 30 mg, or more, of WTPM over at least 10 puffs, under FTC smoking conditions.

In addition to the aforementioned benefits, preferred smoking articles of the present invention are capable of providing an aerosol which is chemically simple, consisting essentially of air, oxides of carbon, water, aerosol former including any desired flavors or other desired volatile materials, and trace amounts of other materials. This aerosol has little or no significant mutagenic activity as measured by the Ames Test. The preferred smoking articles of the present invention also deliver very low levels of carbon monoxide, preferably less than about 10 mg total CO delivery over the life of the smoking article, more preferably, less than about 5 mg total CO delivery (e.g., about 4.2 mg), most preferably less than about 3 mg total CO delivery (e.g., about 2 mg).

As used herein, and only for the purpose of this application, "aerosol" is defined to include vapors, gases, particles, and the like, both visible and invisible, and especialy those components perceived by the user to be "smoke-like", generated by action of the heat from the burning fuel element upon substances contained within the container for the aerosol generating means, or elsewhere in the article. As so defined, the term "aerosol" also includes volatile flavoring agents and/or pharmacologically or physiologically active agents, irrespective of whether they produce a visible aerosol.

As used herein, the term "fast burning fuel segment" may be defined as a carbon/binder mixture, having a burn rate such that a solid cylindrical segment, 50 mm×4.5 mm, burns in a static burn test in less than about 3.5 minutes, preferably less than about 3 minutes. The carbon used to prepare such a fuel segment should normally have a density of less than about 0.25 g/cc as determined by mercury intrusion.

As used herein, the term "slow burning fuel segment" may be defined as a carbon/binder mixture, having a burn rate such that a solid cylindrical segment, 50 mm×4.5 mm, burns in a static burn test in greater than about 4 minutes, preferably greater than about 5 minutes. The carbon used to prepare such a fuel segment should have a density greater than about 0.29 g/cc as determined by mercury intrusion.

As used herein, the term "insulating member" applies to all materials which act primarily as insulators. Preferably, these materials do not burn during use, but they may fuse during use, such as low temperature grades of glass fibers. Suitable insulators have a thermal conductivity in a g-cal/(sec) ($cm^2$) (°C./cm), of less than about 0.05. preferably less than about 0.02, most preferably less than about 0.005. See, Hackh's Chemical Dictionary, 34, 4th ed., 1969 and Lange's Handbook of Chemistry, 10, 272–274 11th ed., 1973.

The preferred smoking articles of the present invention are described in greater detail in the accompanying drawings and in the detailed description of the invention which follow.

BRIEF DESCRIPTION OF THE DRAWING

FIGS. 1A–4A are front end views of the smoking articles of FIGS. 1–4.

DETAILED DESCRIPTION OF THE PREFERRED EMBODIMENTS

Figure 1:
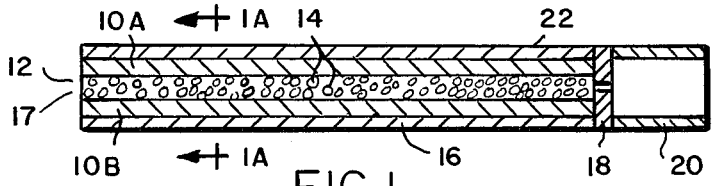
FIGS. 1–4 are longitudinal views of the preferred embodiments of cigarette-like smoking articles of the present invention.
Figure 1A:
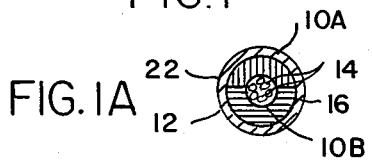

Referring to FIG. 1, there is shown one preferred embodiment of the present cigarette-like smoking article which includes complementary longitudinal fuel segments 10A and 10B and which has about the same overall dimensions as a conventional cigarette.

As illustrated, one longitudinal half of the fuel element 10A is made from molded or extruded carbon prepared from pyrolyzed cotton fiber. The other longitudinal half of the fuel element 10B is a molded or extruded carbon prepared from an admixture of pyrolyzed cotton fiber and pyrolyzed kapok fiber, preferably about 50% by weight each. The overall length of the fuel element is about 55 mm. The outer diameter is about 4.5 mm.

Located centrally within the fuel element is the container 14 for the aerosol generating means which comprises a stainless steel tube having an outer diameter of about 3.0 mm, a wall thickness of about 0.013 mm, and a length of about 55 mm. The tube is open at both ends. This tube includes a substrate material 12 which bears one or more aerosol forming substances.

The fuel segment 10 A/B is overwrapped with an insulating member 16 such as a jacket of fiberglass, to an outer diameter of about 7.5 mm.

At the end of the fuel element, there is located a heat resistant sealing means or barrier member 18. In the illustrated embodiment, this sealing means is a machinable ceramic block, about 2 mm thick and about 7.5 mm in diameter. This member has a hole therein which is aligned with the mouth end of the tube for the aerosol generating means.

Attached to the mouth end of the sealing means 18 is element 20, a hollow tube mouthend piece. As illustrated, the entire article, or portions thereof, may be overwrapped by conventional cigarette paper 22.

Figure 2:
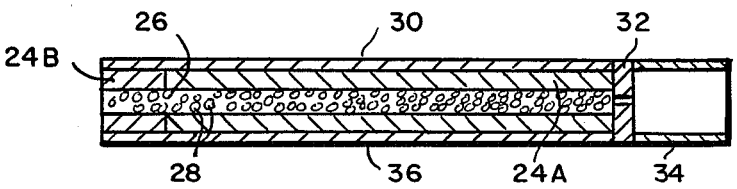
Figure 2A:
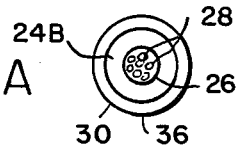

Referring to FIG. 2, there is shown another embodiment of the present cigarette-like smoking article which is similar to the embodiment illustrated in FIG. 1.

As illustrated, the majority of the annular member which comprises the fuel segment 24A is made from molded or extruded carbon prepared from pyrolyzed cotton fiber. Situated at the lighting end of the article, is a short (e.g., 2 to 3 mm) annular section of the fuel element 24B which comprises a molded carbon prepared from an admixture of pyrolyzed cotton fiber and pyrolyzed kapok fiber, preferably about 50% by weight of each. The overall length of the fuel element is about 55 mm. The outer diameter is about 4.5 mm.

Located centrally within the fuel element is the container 26 for the aerosol generating means which comprises a stainless steel tube having an outer diameter of about 3.0 mm, a wall thickness of about 0.013 mm, and a length of about 55 mm. This container or capsule includes a substrate material 28 which has one or more aerosol forming substances therein.

The fuel element 24 A/B is overwrapped with an insulating member 30 such as a fiberglass paper to an outer diameter of about 7.5 mm.

At the end of the fuel element, there is located a heat resistant sealing means 32. In the illustrated embodiment, this sealing means is an inorganic paste, about 0.5 mm thick, which seals the mouth end of the fuel/aerosol generator/insulator segment. This means has a hole therein which is aligned with the mouth end of the capsule for the aerosol generating means.

Attached to the mouth end of the sealing means 32 is element 34, a hollow tube mouthend piece. As illustrated, the entire article, or portions thereof, may be overwrapped by conventional cigarette paper 36.

Figure 3:
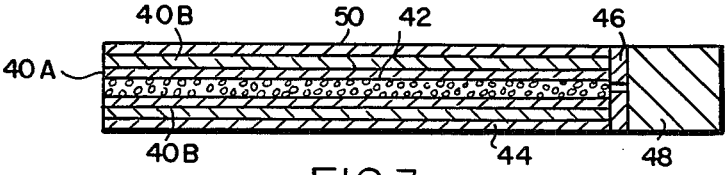
Figure 3A:
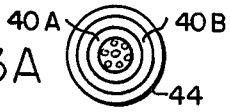

Referring to FIG. 3, there is shown another embodiment of the present cigarette-like smoking article which has about the same overall dimensions as a conventional cigarette.

As illustrated, the aerosol generating means comprises a stainless steel tube 38 having an outer diameter of about 3.0 mm, a wall thickness of about 0.013 mm, and a length of about 55 mm. The aerosol generating means is surrounded by a slow burning annular fuel segment 40A. Fuel segment 40A is surrounded by an annular segment of fast burning fuel 40B. The outer diameter of the concentrically arranged fuel segments is about 6.0 mm, each of the fuel segments contributing about half of the thickness of the fuel.

The container or capsule 38 includes a substrate material 42 which bears one or more aerosol forming substances.

The fuel segment 40 A/B is overwrapped with an insulating member 44 such as a fiberglass layer, preferably to an overall outer diameter of about 7.5 mm.

At the mouth end of the fuel element, there is located a heat resistant sealing means 46, a paste made from bentonite clay and sodium silicate. This sealing means has a hole therein which is aligned with the mouth end of the capsule for the aerosol generating means.

Attached to the mouth end of the sealing means 46 is element 48, a low efficiency cellulose acetate filter piece. As illustrated, the entire article, or portions thereof, may be overwrapped by conventional cigarette paper 50.

Figure 4A:
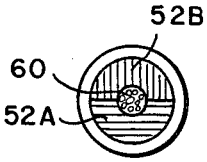
Figure 4:
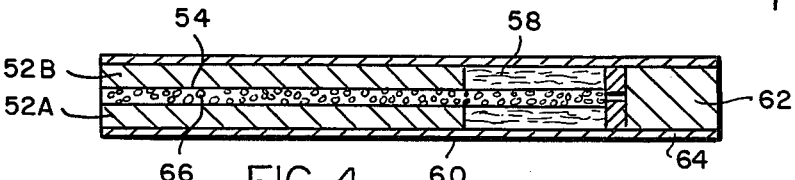

Referring to FIG. 4, there is shown another embodiment of the present cigarette-like smoking article which is similar to the embodiment illustrated in FIG. 1, except that the capsule for the aerosol generating means is not totally encased or embedded within the fuel element.

As illustrated, one longitudinal half of the fuel elemnt 52A is a slow burning molded carbon prepared from pyrolyzed cotton fiber. The other longitudinal half of the fuel element 52B is a fast burning molded carbon prepared from an admixture of pyrolyzed cotton fiber and pyrolyzed kapok fiber, preferably about 50% by weight of each. The overall length of the fuel element is about 40 mm. The outer diameter is about 4.5 mm.

Located centrally within the 40 mm long fuel element is the container 54 for the aerosol generating means which comprises a stainless steel tube having an outer diameter of about 3.0 mm, a wall thickness of about 0.013 mm, and a length of about 60 mm. This container or capsule includes a substrate material 56 which has one or more aerosol forming substances therein. The remaining 20 mm of the capsule is surrounded by a molded fiberglass 58, up to an outer diameter of about 7.5 mm, which member aids in sealing the article.

The fuel segment 52 A/B is overwrapped with an insulating member 60 such as a fiberglass paper to an outer diameter of about 7.5 mm.

At the end of the molded fiberglass member 58, there is located a low efficiency filter element 62, comprising cellulose acetate tow.

As illustrated, the entire article, or portions thereof, may be overwrapped by conventional cigarette paper 64.

Upon lighting any of the aforesaid embodiments, the fast burning segment burns first, which assists the ignition and the burning of the slow burning segment, both of which generate the heat used to volatilize the aerosol forming substance or substances in the aerosol generating means.

The use of a dual burn rate fuel element ensures steady aerosol delivery throughout the useful life of the article. The initial aerosol delivery is primarily due to the rapid burning and heat generation by the fast burning component of the fuel element. The later stage delivery of aerosol is primarily provided by the slower burning fuel component of the fuel element.

Heat transfer from the burning fuel components to the aerosol generating means is aided by the use of an insulating member as a peripheral overwrap over the fuel element. Such an insulating member helps ensure good aerosol production by retaining and directing much of the heat generated by the burning fuel element toward the aerosol generating means.

The aerosol generating means used in practicing this invention is physically separate from the fuel element. This arrangement helps reduce or eliminate thermal degradation of the aerosol forming substance and the presence of significant amounts of sidestream smoke. While not a part of the fuel element, the aerosol generating means preferably is totally surrounded by the fuel element. In addition, by virtue of their physical arrangement, the fuel and the aerosol generating means are in a conductive heat exchange relationship.

While not wishing to be bound by theory, it is believed that after the fuel element is ignited, the combustion zone (or zones) continually advances from the lighting end toward the mouth end. As the heat from the combustion zone advances along the periphery of the aerosol generating means, volatile substances on the substrate (aerosol former, flavors, and the like) are continuously moved downstream where they recondense when encountering cool substrate material. A section of the substrate material between the combustion zone and the cool section is always being preheated by conductive heat from the burning fuel element. During a puff, sufficient additional heat is suplied by air being drawn through the hot substrate nearest the combustion zone, and this hot air causes vaporization of the aerosol forming substances located in the cooler sections of the aerosol generating means.

It is further believed that the aerosol generating means is maintained at a relatively constant temperature during both smolder and puffing, and that aerosol delivered during puffs is not subjected to any increase in overall temperature.

Fiberous materials which after carbonization will have slow or fast burning properties may readily be determined by the skilled artisan. As described herein, a static burn test is one method which may be employed to classify pyrolyzed material as either "fast" or "slow" burning. In addition to the "burn test", it has been found that based upon the density of the pyrolyzed material, one can classify material as being either a "fast" or "slow" burning carbon.

In general it has been found that naturally occurring low density fibrous materials having a substantially open network within the fibers will generally qualify as a "fast" burning material after being pyrolyzed. While not wishing to be bound by theory, it is believed that the open network within the fibers supplies oxygen needed to support combustion.

More dense, and thus, more closed network fibrous materials will generally be classified herein as "slow" burning material when pyrolyzed.

It must be noted that fast burning carbonized fibers can be mixed with slow burning fibers to create an overall fast burning fuel or vice versa, slow burning carbonized fibers can be mixed with fast burning fibers, to make an overall slow burning fuel.

Preferred pyrolysis conditions employed herein for the production of both "fast" and "slow" burning segments of fuel elements comprise the use of a non-oxidizing e.g., inert atmosphere during the carbonization, and during the cooling of the pyrolyzed material. Preferred non-oxidizing atmospheres include inert gases, e.g., nitrogen, argon, and the like. Vacuum conditions may likewise by employed. The pyrolysis temperature may range of from about 400° C. to 850° C., and is preferably about 650° C.

A slow pyrolysis, employing gradually increasing temperatures over several hours, has been found to produce a uniform material and a high carbon yield.

Fiberous materials which may be pyrolyzed to afford one or both of the segments of the present fuel elements include: *Agaye american,* - (American aloe); *Apocyanum cannabinum,* - (Indian hemp); *Apocyanum androsaemitolium,* - (Black indian hemp); *Ascepias incarnata,* - (Swamp milkweed, white indian hemp); *Ascepias syriaca,* - (Milkweed, silkweed); *Cannabis sativa,* - (Hemp); *Linum usitatissimum,* - (Flax); Ophioglossaceae sp., - (Adders toung fern); *Tilia americana,* - (American basswood); *Musa textilis,* - (Leaf (hard) fibers abaca); *Agave cantal,* - (cantala); *Neoglaziovia variegata,* - (caroa); *Agage fourcroydes,* - (henequen); Agave sp., - (istle (generic)); *Furcraea gigantea,* - (mauritius); *Phormium tenax* - (phormium); Sansevieria (entire genus - bowstring hemp); *Agave sisalana* - (sisal); *Abutilon theophrasti* - (china jute); *Hibiscus cannabinus* - (kenaf); *Boehmeira nivea* - (ramie); *Hibiscus sabdarifa* - (roselle) *Crotalaria juncea* - (sunn); *Urena labata* - (cadillo); Gossypium sp. - (cotton); *Ceiba pentranda* - (kapok); *Muhlenbergia macroura* - broom root (roots); *Cocos nucifera* - (coir - coconut husk fiber); *Chamaerops humilis* - (crin vegetal - palm leaf segments); *Attalea funifera* - piassava - palm leaf base fiber).

Binders which may be used to prepare the segments of the fuel element include the polysaccharide gums, such as the plant exudates; Arabic, Tragacanth, Karaya, Ghatti; plant extracts, pectin, arabinoglactan; plant seed flours, locust bean, guar, psyllium seed, quincy seed; the seaweed extracts, agar, alginates, carrageenan, furcellaran; cereal starches, corn, wheat, rice, waxy maize, sorghum, waxy sorghum, tuber starches, potato, arrowroot, tapioca; the microbial fermentation gums, Xanthan and dextran; the modified gums include cellulose derivatives, sodium carboxymethylcellulose, methylcellulose, hydroxypropylmethylcellulose, methylethylcellulose, hydroxypropylcellulose, modified alginates, e.g.

propylene glycol alginate. Also suitable are the modified starches; carboxymethyl starch, hydroxyethyl starch and hydroxypropyl starch.

In a preferred embodiment, cotton and kapok fibers are carbonized and molded into the form of a fuel element with one or more appropriate binders which are used to maintain an integral structure. These fibers are carbonized in a non-oxidizing e.g., nitrogen, atmosphere. The preferred carbonizing temperature for these two fibers is about 650° C. The preferred time for pyrolyzing these fibers is about two hours.

The preferred fuel is prepared by separately admixing each of the carbonized fibers (or mixtures thereof) 10 parts by weight with sodium carboxymethylcellulose 1 parts by weight to form two pastes. These pastes are molded into a rod approximately 4.5 mm in outer diameter.

The preferred mold consisted of two identical metal blocks into which a groove was cut such that when the two blocks were placed together a central cylindrical passage is formed. Each of the grooves is lined with a thin paper, such as cigarette paper. This prevents sticking of the carbon paste to the metal mold. The carbon pastes are each spread into one of the grooved mold blocks.

Measurements were made to determine the bulk density of molded solid cylindrical carbon fuel rods. Mercury intrusion was the test method. See Table I.

TABLE I

CARBON ROD DENSITY

| Carbon Sample | Bulk Density g/cc |
|---|---|
| 100% Cotton | 0.3463 |
| 50% Kapok-50% Cotton | 0.2440 |
| 100% Kapok | 0.1984 |

The burn rate for these molded solid cylindrical carbon fuel rods was measured by observing the time required to burn 50 mm of a 4.5 mm O.D. molded carbon segment. This was a static burn test, i.e., air was not forced over or through the burning fuel. See Table II.

TABLE II

CARBON ROD STATIC BURN TEST

| Carbon Sample | Time Min.-Sec. |
|---|---|
| 100% Kapok | 2:34 |
| 100% Cotton | 5:59 |
| 50% Kapok-50% Cotton | 3:28 |

Located centrally within the fuel element of the present article is a container or capsule for the aerosol generating means. This capsule is prepared from a heat conducting material, preferably a metal, which can survive at the temperatures generated by the burning of the fuel element.

The heat conducting material which may be employed to construct the container for the aerosol generating means is typically a metallic tube, strip, or foil, such as aluminum, copper, or steel, with a wall thickness of about 0.0127 mm (0.0005 in.) or less. The length, thickness and/or the type of conducting material may be varied e.g., other metals may be used.

The preferred metal tube is formed from thin annealed stainless steel foil by wrapping the same around a mandrel and then welding the seam. An especially preferred stainless steel foil is from about 0.0127 mm (0.0005 in.) thick and is obtained from Hamilton Precision Metals, a division of HMW Industries, Inc., Lancaster, Pa., or from Teledyne Rodney Metals, New Bedford, Mass.

The capsule for the aerosol generating means contains one or more aerosol forming substances, generally retained on a carrier or similar substrate material. Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel.

Useful thermally stable materials include adsorbent carbons, such as porous grade carbons, graphite, activated, or non-activated carbons, and the like, such as PC-25 and PG-60 available from Union Carbide Corp., Danbury, Conn., as well as SGL carbon, available from Calgon. Other suitable materials include inorganic solids, such as ceramics, glass, alumina, vermiculite, clays such as bentonite, and the like. Carbon and alumina substrates are preferred.

An especially preferred alumina substrate is available from the Davison Chemical Division of W. R. Grace & Co. under the designation SMR-14-1896. Before use, this alumina is sintered at elevated temperatures, e.g., greater than 1000° C., washed, and dried.

The aerosol forming substance or substances used in the articles of the present invention must be capable of forming an aerosol at the temperatures present in the aerosol generating means upon heating by the burning fuel element.

Substances having these characteristics include: polyhydric alcohols, such as glycerin, triethylene glycol, and propylene, glycol, as well as aliphatic esters of mono-, di-, or poly-carboxylic acids, such as methyl stearate, dodecandioate, dimethyl tetradodecandioate, and the like.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouth end, such as in a separate substrate or chamber.

One particularly preferred aerosol generating means comprises the aforesaid alumina substrate containing spray dried tobacco extract, tobacco flavor modifiers, such as levulinic acid, one or more flavoring materials, and an aerosol forming material, such as glycerin.

Articles of the type disclosed herein may be used or may be modified for use as drug delivery articles, for delivery of volatile pharmacologically or physiologically active materials such as ephedrine, metaproterenol, terbutaline, or the like.

The fuel element of the present article is preferably encased or surrounded by an insulating member which may be in the form of a resilient jacket or a hard, molded insulating jacket. In either event, this jacket is at least about 0.5 mm thick, preferably at least about 1 mm thick, more preferably between about 1.5 to 2 mm thick. This element aids in the transfer of heat from the burning fuel element to the aerosol generating means, by directing the heat inward. The insulating jacket also ensures that no ash from the burning fuel element escapes from the article.

Insulating members which may be used in accordance with the present invention generally comprise inorganic or organic fibers such as those made out of glass, alumina, silica, vitreous materials, mineral wool, carbons, silicons, boron, organic polymers, and the like, including mixtures of these materials. Nonfibrous insulating materials, such as silica aerogel, pearlite, glass, and the like may also be used.

Preferred insulating members are resilient, which helps the article simulate the feel of a conventional cigarette. The currently preferred insulating fibers are ceramic fibers, such as glass fibers. Two especially suitable glass fibers are available from the Manning Paper Company of Troy, N.Y., under the designations, Manninglas 1000 and Manniglas 1200. When possible, glass fiber materials having a low softening point, e.g., below about 650° C., are preferred. The most preferred glass fibers include experimental materials produced by Owens - Corning of Toledo, Ohio under the designations 6432 and 6437.

Several commercially available inorganic insulating fibers are prepared with a binder e.g., PVA, which acts to maintain structural integrity during handling. These binders, which would exhibit a harsh aroma upon heating, are preferably removed, e.g., by heating in air at about 650° C. for up to about 15 min. before use herein. If desired, pectin, at up to about 3 wt. percent may be added to the fibers to provide mechanical strength to the jacket without contributing harsh aromas.

Located at the mouthend of the fuel element portion of the present smoking article is a heat stable sealing or barrier means. This sealing means serves several purposes; first, it prevents the fuel element from igniting the mouthend portion of the article; second, it serves as a seal between the combustion end of the article and the delivery end. This ensures that little if any combustion gases will mix with the aerosol being delivered to the user. The sealing means may be selected from any heat resistant material available to the skilled artisan. These materials may be used alone, or in admixture with other sealing agents such as sodium silicate. For example, inorganics, such as silica, clays (e.g., bentonite), puttys, adhesives, and fillers available from Cotronics Inc., Brooklyn, NY and Flexbar Machine Corp. Central Islip, NY have been used herein.

One currently preferred sealing means is a paste-like mixture of bentonite clay and sodium silicate, which can be painted on the mouth end of the fuel element/aerosol generating means combination, which, after it has dried, acts as an efficient seal against contamination of the mainstream aerosol by fuel combustion gases.

In most embodiments of the invention, the fuel and aerosol generating means will be attached to a mouthend piece, although a mouthend piece may be provided separately, e.g., in the form of a cigarette holder. this element of the article provides the enclosure which channels the vaporized aerosol forming substance into the mouth of the user. The mouthend piece also keeps the hot fire cone away from the mouth and fingers of the user, and provides sufficient time for the hot aerosol to cool before reaching the user. Suitable mouthend pieces will be apparent to those of ordinary skill in the art.

The mouthend pieces of the invention may include an optional "filter" tip, which is used to give the article the appearance of the conventional filtered cigarette. Such filters include low efficiency cellulose acetate filters and hollow or baffled plastic filters, such as those made of polypropylene. Such filters do not appreciably interfere with the aerosol delivery.

The entire length of the article, or any portion thereof, may be overwrapped with one or more layers of cigarette paper. Preferred papers should not openly flame during burning of the fuel element. In addition, the paper should have controllable smolder properties and should produce a grey, cigarette-like ash.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer.

Papers such as these are known in the cigarette and/or paper arts and mixtures of such papers may be employed for various functional effects. Preferred papers used in the articles of the present invention include Kimberly Clark's P 850-162, P 878-16-2, and 850-163 papers.

The aerosol produced by the preferred articles of the present invention (measured as wet total particulate matter, or WTPM) is chemically simple, consisting essentially of air, water, oxides of carbon, the aerosol former, any desired flavors or other desired volatile materials, and trace amounts of other materials.

The aerosol of produced by the preferred articles of the present invention contains very little carbon monoxide.

The WTPM produced by the preferred articles of this invention has little or no measurable mutagenic activity as measured by the Ames test, i.e., there is little or no significant dose response relationship between the WTPM produced by preferred articles of the present invention and the number of revertants occurring in standard test microorganisms exposed to such products. According to the proponents of the Ames test, a signicant dose dependent response indicates the presence of mutagenic materials in the products tested. See Ames et al., *Mut. Res.*, 31: 347–364 (1975); Nagao et al., *Mut. Res.*, 42: 335 (1977).

The present invention will be further illustrated with reference to the following examples which aid in the understanding thereof, but which are not to be construed as limitations thereof. All percentages reported herein, unless otherwise specified, are percent by weight. All temperatures are expressed in degrees Celsius and are uncorrected.

EXAMPLE 1

Smoking articles substantially as illustrated in FIG. 1 were prepared as follows:

Aerosol Generating Means:

A. The Capsule:

The aerosol capsule, about 55 mm in length, having an outer diameter of about 2.9 mm, was prepared from tubing made from annealed stainless steel foil.

The tube was formed from the stainless steel foil by wrapping the foil around a mandrel and then welding the seam with a welder known as the Rocky Mountain Model 660 produced by Rocky Mountain/Associates International Inc., Denver, Colo.

The metal foil, which had a thickness of about 0.0005 inch, was obtained from Hamilton Precision Metals.

B. Tobacco Extract:

The tobacco extract used in this example was prepared as follows. Flue cured tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours.

The admixture was centrifuged to remove suspended solids and the aqueous extract was spray dried by continuously pumping the aqeuous solution to a conventional spray dryer, such as an Anhydro Size No. 1, at an inlet temperature of from about 215°-230° C. and collecting the dried powder material at the outlet of the drier. The outlet temperature varied from about 82°-90° C.

C. Alumina Substrate:

High surface area alumina (surface area=280 $m^2/g$) from W. R. Grace & Co. (designated SMR-14-1896), having a mesh size of from −8 to +14 (U.S.) was sintered at a soak temperature above about 1400° C., preferably from about 1400° to 1550° C., for about one hour and cooled. The alumina was washed with water and dried.

D. Aerosol Former:

An aerosol generating composition comprising 200 mg of treated alumina was prepared by admixing:

Alumina - 62.26%
SD-FC - 10.34%
B-3 - 21.2%
LEV - 0.64%
Flav. - 1.74%
Water - 2.12% wherein SD-FC is spray dried flue cured tobacco extract; B-3 is glycerin; LEV is levulinic acid; and Flav. is a flavorant composition T69-22 obtained from Firmenich of Geneva, Switzerland.

Fuel Preparation:

Kapok and cotton fibers were separately carbonized in a nitrogen atmosphere. The carbonizing temperature was 650° C. This temperature and atmosphere was maintained for two hours before cooling under nitrogen began.

In this example, one half of the fuel element was a 100% cotton based carbon fibers, while the other half was a 50% - 50% mixture (by weight) of cotton based carbon and kapok based carbon fibers.

The two carbonized fiber groups (10 parts by weight) were independently mixed with sodium carboxymethylcellulose (1 parts by weight - Hercules - 7HF). Two carbon/NaCMC pastes resulted.

The mold used to prepare the carbon fuel segment consisted of two identical metal blocks into which a groove was cut on one side so that when the two blocks were placed together a cylindrical passage was formed. Each groove was lined with thin paper, such as conventional cigarette paper. This was used to prevent the sticking of the carbon paste to the metal mold.

The two carbon/SCMC pastes were coated on their respective molds. In one mold, the metal tube was centered within the paste. Ring spacers along the periphery of the tube held the tube centered within the carbon paste. The two paste filled molds were then clamped together and the carbon paste was dried. When the mold was taken apart, any excess carbon was removed from beyond the ends of the central metal tube and the paper wrapper was removed.

Final Construction:

The stainless steel tube contained within the fuel element was filled with the 200 mg of aerosol former. The ends of the tube were crimped slightly to retain the substrate. The fuel segment was then wrapped with a sheet of Owens Corning No. 6423 glass fibers, to an overall circumference of about 22.4 mm.

At the mouthend of the article there was placed a barrier member comprising a coating of an aqueous paste of sodium silicate and bentonite clay.

A mouthend piece comprising a rigid paper tube segment (10 mm×7.5 mm) was attached to the jacketed fuel by means of a paper overwrap. Kimberly Clark P 780-63-5 was used in this embodiment.

EXAMPLE 2

Smoking articles substantially as illustrated in FIG. 3 were prepared as follows:

Aerosol Generating Means:

The aerosol capsule, about 60 mm in length, having an outer diameter of about 2.9 mm (0.115 in.), was prepared from tubing made from 0.0005 in. thick stainless steel foil as in Example 1. This tube was filled with 200 mg of the aerosol forming material used in Example 1, and the ends of the tube were crimped in to retain the alumina.

Fuel Preparation:

Kapok and cotton fibers were carbonized as in Example 1. As in Example 1, part of the fuel element was prepared from 100% cotton based carbon fibers, while part of the fuel element was prepared from a 50% - 50% mixture (by weight) of cotton based carbon and kapok based carbon fibers.

The two carbonized fiber groups (10 parts by weight) were independently mixed with sodium carboxymethylcellulose (1 part by weight - Hercules - 7HF). Two carbon/NaCMC pastes resulted.

Two molds, each similar to that used in Example 1, were used to prepare the carbon fuel segment of this Example.

The first mold defined a space of 3.96 mm (0.156 in.) in diameter. The stainless steel tube was placed in this mold, similar to the molding step of Example 1, that is, 100% cotton carbon/SCMC paste was coated the two halves of the mold. When the mold was closed, the tube became centered within the carbon paste. The mold was clamped tightly closed and the carbon paste was dried.

The carbon coated tube was removed from the first mold and placed in a second, larger mold, defining a space 5.16 mm (0.203 in.) in diameter containing the 50% cotton carbon - 50% kapok carbon prepared above. This second mold was clamped tightly around the coated tube, and after the carbon paste had dried, the article was removed therefrom. The tube was then filled with about 200 mg of the treated alumina substrate, and each end was crimped slightly. The periphery of the carbon fuel segment was overwrapped with Owens-Corning glass fiber paper No. 6437 to a final outside diameter of about 7.8 mm.

The mouth end of the fuel element was treated with a paste made from sodium silicate and bentonite clay. Once this sealing means had dried, a hollow plastic tube mouthend piece 25 mm in length, 7.8 mm in diameter, was attached by an overwrap of Kimberly Clark P-878-16-2 paper. This article was smoked under standard FTC smoking conditions, affording the following results:

WTPM: 24.9 mg
puffs: 12
CO: 3.0 mg

EXAMPLE 3

The following table (III) describes the CO output for preferred smoking articles of the present invention. These articles were substantially those described in FIG. 1 and Example 1, but the outer diameter of the fuel element was varied. Each of the articles was overwrapped with a fiberglass insulating jacket to the outer diameter of a conventional cigarette. Standard FTC smoking conditions were employed, i.e., a 35 ml puff of 2 seconds duration, once every minute.

TABLE III

| CO/$CO_2$ DELIVERY DATA | | | | |
|---|---|---|---|---|
| Carbon O.D. mm | WTPM | CO | $CO_2$ | Puffs |
| 4.5 | 20.7 | 3.07 | 18.99 | 10 |
| 4.5 | 26.6 | 1.78 | 6.44 | 14 |
| 5.2 | 37.0 | 6.13 | 18.42 | 10 |
| 5.2 | 38.6 | 3.85 | 12.35 | 11 |
| 5.2 | 30.7 | 2.29 | 11.14 | 9 |
| 5.2 | 36.3 | 2.64 | 9.01 | 10 |
| 5.2 | 32.3 | 3.30 | 12.61 | 10 |
| 5.2 | 33.7 | 3.48 | 13.94 | 11 |
| 5.4 | 32.3 | 1.89 | 10.15 | 12 |
| 5.4 | 29.3 | 4.16 | 13.39 | 10 |
| 5.6 | 24.7 | 3.37 | 19.80 | 14 |
| 5.6 | 33.8 | 1.52 | 16.67 | 13 |
| 5.6 | 21.4 | 4.11 | 25.50 | 12 |
| 5.6 | 36.9 | 2.53 | 12.61 | 12 |
| 5.9 | 22.6 | 3.36 | 23.73 | 13 |

EXAMPLE 4

In another test of performance, twenty preferred articles were tested on a 20-port smoking machine using FTC smoking conditions. All of the models were identical and contained the 5.2 mm O.D. carbon fuel and the aerosol generating means of Example 1. The results (average) are shown in Table V:

TABLE IV

| WTPM | Nicotine | Glycerine | CO |
|---|---|---|---|
| 25.0 mg | 0.72 mg | 10.9 mg | 3.4 mg |

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A smoking article comprising:

(a) an aerosol generating means including an aerosol forming material;

(b) an elongated heat conductive enclosure means for said aerosol generating means; and (c) a dual burn rate, annular, carbonaceous fuel element comprising a slow burning segment and a fast burning segment which circumscribes at least a portion of the enclosure means.

2. The smoking article of claim 1, wherein the fuel element circumscribes substantially the entire length of the enclosure means.

3. The smoking article of claim 1 or 2, wherein the fuel element comprises complementary longitudinal segments.

4. The article of claim 3, wherein the fast burning longitudinal segment of the fuel element contacts the enclosure means along up to one half of its periphery.

5. The smoking article of claim 1 or 2, wherein the fast burning segment circumscribes at least a portion of the enclosure means and the slow burning segment of the fuel element circumscribes said fast burning segment.

6. The smoking article of claim 1 or 2, wherein the fast burning segment of the fuel element is located at the lighting end of the article.

7. The smoking article of claim 1 or 2, wherein the heat conductive enclosure is spaced at least about 2 mm from the lighting end of the fuel element.

8. The smoking article of claim 1 or 2, further comprising an insulating member which circumscribes at least a portion of the fuel element.

9. The smoking article of claim 8, wherein the insulating member is a resilient, non-burning member at least 0.5 mm thick.

10. The smoking article of claim 8, wherein the insulating member is a rigid, non-burning member at least 0.5 mm thick.

11. The smoking article of claim 8, wherein the insulating member comprises glass fibers.

12. The smoking article of claim 8, wherein the fuel element is from about 3 to 6 mm in outer diameter, the aerosol generating means is from about 1.5 to 4.5 mm in outer diameter, both of which are from about 40 to 65 mm in length.

13. The article of claim 8, wherein the fast burning segment has a density less than about 0.25 g/cc and the slow burning segment has a density greater than about 0.29 g/cc.

14. The article of claim 8, wherein the fast burning segment comprises pyrolyzed kapok and the slow burning segment comprises pyrolyzed cotton.

15. The smoking article of claim 2, wherein the overall carbon monoxide delivery over 10 FTC puffs is less than about 4.2 mg.

16. The smoking article of claim 2, wherein the overall carbon monoxide delivery over 10 FTC puffs is less than about 2.0 mg.

17. The smoking article of claim 2, wherein the WTPM delivery over 10 FTC puffs is greater than about 20 mg.

18. The smoking article of claim 2, wherein the WTPM delivery over 10 FTC puffs is greater than about 30 mg.

19. A cigarette-like smoking article comprising:

(1) a two segment annular fuel element greater than 40 mm in length, one segment of which comprises a mixture of pyrolyzed kapok fibers and pyrolyzed cotton fibers, admixed with binder, the other segment of which comprises pyrolyzed cotton fibers admixed with binder;

(b) a annular heat conductive container substantially equal in length to the fuel element, said container being encircled by said fuel element and holding a substrate bearing one or more aerosol forming materials; and (c) a mouthend piece;

20. The smoking article of claim 19, wherein the fuel element has a diameter of from about 4.5 to 5.5 mm.

21. The smoking article of claim 16, wherein the container has a diameter of from about 2.5 to 3.5 mm.

22. The article of claim 21, wherein the container is less than about 0.013 mm thick.

23. The smoking article of claim 19, 20, or 21, wherein the ratio of pyrolyzed kapok and pyrolyzed cotton in the mixture is from about 5:1 to 1:5.

24. The smoking article of claim 19, 20, or 21 wherein the ratio of pyrolyzed kapok and pyrolyzed cotton in the mixture is about 1:1.

25. The smoking article of claim 19, 20, or 21, which further comprises an insulating member which encircles at least a portion of the fuel element.

26. The smoking article of claim 22, wherein the insulating member is a resilient, non-burning member at least 0.5 mm thick.

27. The smoking article of claim 22, wherein the insulating member is a rigid, non-burning member at least 0.5 mm thick.

28. The smoking article of claims 23 or 24, wherein the insulating member comprises glass fibers.

* * * * *